United States Patent [19]

Itoh et al.

[11] Patent Number: 4,994,157

[45] Date of Patent: Feb. 19, 1991

[54] METHOD AND APPARATUS FOR DESCALING STAINLESS STEEL

[75] Inventors: Masahiko Itoh, Hitachiota; Heihatiro Midorikawa, Hitachi; Masakiyo Izumiya, Mito; Teruo Yamaguchi, Hitachi, all of Japan

[73] Assignee: Hitachi, Ltd., Tokyo, Japan

[21] Appl. No.: 426,761

[22] Filed: Oct. 26, 1989

[30] Foreign Application Priority Data

Oct. 29, 1988 [JP] Japan ..... 63-271960

[51] Int. Cl.[5] ..... C25F 1/06; C25D 17/00

[52] U.S. Cl. ..... 204/145 R; 204/209; 204/210

[58] Field of Search ..... 204/145 R, 206, 209, 204/210

[56] References Cited

U.S. PATENT DOCUMENTS

| | | | |
|---|---|---|---|
| 3,254,011 | 5/1966 | Zaremski | 204/145 R |
| 4,021,299 | 3/1977 | Zaremski et al. | 204/145 R |
| 4,711,707 | 12/1987 | Kikuchi et al. | 204/145 R |

FOREIGN PATENT DOCUMENTS

| | | |
|---|---|---|
| A100595 | 9/1982 | European Pat. Off. . |
| 3812162 | 12/1958 | Japan . |
| 109520 | 7/1974 | Japan . |
| 109908 | 7/1974 | Japan . |
| 97228 | 4/1975 | Japan . |
| 53-13173 | 5/1978 | Japan . |

*Primary Examiner*—T. M. Tufariello

*Attorney, Agent, or Firm*—Fay, Sharpe, Beall, Fagan, Minnich & McKee

[57] ABSTRACT

A method of descaling stainless steel which provides a smooth and glossy surface, comprises the steps of (a) anode-electrolyzing stainless steel having scales thereon in an aqueous neutral salt solution, (b) anode-electrolyzing or immersing the stainless steel in an aqueous alkaline solution. Steps (a) and (b) are performed in the order of either (a), (b), (a). The method further comprises the step of cathode-electrolyzing the stainless steel treated in the previous two steps in an aqueous nitric acid solution or immersing it in an aqueous solution of a mixture containing nitric acid and fluoric acid.

16 Claims, 2 Drawing Sheets

METHOD AND APPARATUS FOR DESCALING STAINLESS STEEL

OF THE INVENTION

The present invention relates to the descaling of stainless steel, and particularly to a method and an apparatus for descaling which is suitable for removing at high speed oxide scales occurring in continuous annealing after cold rolling, as well as to descaled stainless steel obtained by the method.

BACKGROUND OF THE INVENTION

Cold-rolled stainless steel strips are generally subjected to annealing heat treatment for the purpose of changing work-hardened layers. Oxide scales occurring on the surface of stainless steel during this treatment cause significant deterioration in its value as a commercial product. Such oxide scales therefore must be removed. Descaling methods concern a process in which stainless steel is electrolyzed in a strong acid such as sulfuric acid and a method in which stainless steel is immersed in a molten alkaline salt. These methods involve problems with respect to the roughness of the surface, a lengthy period of time for the descaling process, and difficulty in handling. In order to resolve the problems, there has been proposed a method in which stainless steel is electrolyzed in an aqueous neutral salt solution and then immersed in an aqueous solution of a mixture containing nitric acid and fluoric acid, as disclosed in Japanese Patent Examined Publication No. 38-12162. Also, a method in which stainless steel is electrolyzed in an aqueous neutral salt solution and then electrolyzed in a solution containing nitric acid ions, has been disclosed in Japanese Patent Examined Publication No. 53-13173.

In the above-mentioned prior art, attention is paid only to descaling of the surface of the stainless steel, and insufficient consideration is given to the glossiness and the smoothness of the surface of the descaled stainless steel or to the speed of descaling treatment and improvements of a high-temperature operation when effecting immersion in a molten alkaline salt. There are therefore difficult problems with respect to an increase in the speed of descaling and an improvement in the workability.

OBJECT OF THE INVENTION

It is an object of the present invention to provide a high-speed descaling method and apparatus which are not accompanied by high-temperature treatment and provide smooth and glossy descaled stainless steel.

SUMMARY OF THE INVENTION

The present invention provides a method comprising the steps of (a) anode-electrolyzing stainless steel having scales thereon in an aqueous neutral salt solution, (b) anode-electrolyzing or immersing stainless steel in an aqueous alkaline solution, the steps (a) and (b) being performed in the order of either (a), (b) or (b), (a); and the step of cathode-electrolyzing the stainless steel, which has been treated in both steps, in an aqueous nitric acid solution or immersing it in an aqueous solution of a mixture of nitric acid and fluoric acid. method, the present invention also provides an apparatus for continuously descaling the stainless steel comprising an electrolytic cell (A) containing an aqueous neutral salt solution and having a plurality of positive and negative electrodes, an electrolytic cell or immersion cell (B) containing an aqueous alkaline solution and having a plurality of positive and negative electrodes, both cells (A) and (B) being provided in the order of (A), (B) or (B), (A), and an electrolytic cell containing an aqueous nitric acid solution or an immersion cell containing an aqueous solution of a mixture of nitric acid and fluoric acid, which electrolytic cell has a plurality of positive and negative electrodes and both of which cells are provided behind the two cells (A) and (B). Regarding austenitic or ferritic stainless steel, AISI 410, 430, 304, 316 or the like is used.

Each of the electrolytic cells of the continuous descaling apparatus has electrodes which are insoluble electrodes disposed opposite to a stainless steel strip continuously moved at high speed. The steel strip can be moved at 60 m/minute or more so that rolling, annealing and descaling can be continuously effected. In the descaling of the present invention, slight oxide scales which occur on the surface of the strip during annealing in a non-oxidizing atmosphere can be removed. The descaling of the invention is therefore particularly suitable for removing scales which have a mass of 100 $\mu g/cm^2$ or less. The annealing atmosphere is preferably one of a combustion exhaust gas of a liquified natural gas, butane gas and etc., containing a slight oxidizing gas.

Such scales can be substantially removed by practicing the method of the present invention using the apparatus therefore, whereby stainless steel, having excellent glossiness and smoothness, can be obtained at high speed in an easy process.

The method of descaling stainless steel of the present invention comprises the steps of removing a chromium oxide layer formed on the outermost surface of the stainless steel, removing a chromium oxide layer containing manganese and iron, and removing iron oxide, these steps being successively performed by using appropriate solutions.

The method of descaling stainless steel of the present invention also comprises the steps of dissolving to $Cr_2O^{2-}$ ions a chromium oxide contained in scales formed on the surface of the stainless steel, dissolving to $CrO_4^{2-}$ ions the chromium oxide contained in the scales, and dissolving to $Fe^{2+}$ ions the iron oxide contained in the scales, these steps being successively performed by using appropriate solutions.

The method of continuously producing a stainless steel strip at high speed of the present invention, comprises the steps of cold-rolling a descaled stainless steel strip after hot-rolling, annealing the strip by electrical heating in a non-oxidizing atmosphere, anode-electrolyzing the stainless steel strip in an aqueous neutral salt solution after cooling the annealed strip, anode-electrolyzing the strip in an aqueous alkaline solution, and cathode-electrolyzing the strip in an aqueous nitric acid solution, these steps being successively performed while the stainless steel is conveyed at high speed.

The apparatus for continuously producing a stainless steel strip of the present invention, comprises a cold-rolling mill for cold-rolling a descaled stainless steel strip after hot-rolling, an annealing furnace for annealing the strip b electrically heating it in a non-oxidizing atmosphere after the cold-rolling, a cooling apparatus for cooling the strip after the annealing, and a descaling apparatus for descaling the strip after the cooling. The descaling apparatus comprises an electrolytic cell containing an aqueous neutral salt solution and having a plurality of positive and negative electrodes. The invention further comprises an electrolytic cell containing an aqueous alkaline solution which has a plurality of positive and negative electrodes. and an electrolytic cell which is provided behind the two cells and which cell contains an aqueous nitric acid solution and which cell has a plurality of positive and negative electrodes.

The scales occurring on the surface of stainless steel during the annealing treatment are composed of a spinel oxide. Normal annealing treatment (at 800° C. or higher) causes an iron-chromium spinel oxide composed of $FeCr_2O_3$ containing $Fe_3O_4$. The electrolysis or immersion treatment of stainless steel having scales is effected for removing scales in each of the aqueous neutral salt solution, the aqueous alkaline solution and the aqueous nitric acid solution or aqueous solution of a mixture of nitric and fluoric acid, and has the following function.

The primary function of the using the neutral salt is to dissolve the chromium contained in the ion-chromium spinel oxide. Namely, the potential-pH diagram of a Cr-$H_2O$ system (M. Pourbaix: Atlas of Electrochemical Equilibria in Aqueous Solutions (1966), Pergamon Press) shows that chromium is dissolved to $Cr_2O_7^{2-}$ ions by anode polarization at +0.2 V or higher based on a saturated calomel electrode within the pH region of neutral to acid. Normal electrolysis using a neutral salt employs as an electrolytic solution an aqueous $Na_2SO_4$ solution which has the function of increasing the conductance of the electrolytic solution. Since electrolysis is generally effected within the pH region of neutral to weak acid, the scales are dissolved to $Cr_2O_7^{2-}$ ions. The concentration of the electrolytic solution is preferably 10 to 30% by weight, more preferably 15 to 25% by weight. The temperature of the solution is 60° to 95° C. and the current density thereof is not less than 10 mA/dm$^2$ and preferably 1 to 10 mA/dm$^2$.

The electrolysis in an aqueous alkaline solution such as an aqueous NaOH, LiOH or KOH solution or the like has the function of dissolving the chromium contained in the scales. It is found that, in this case, the electrolytic potential is obtained by anode polarization at a noble potential of a about −0.35 V or more based on a saturated calomel electrode at pH 13 to 14. In other words, the chromium oxide can be effectively removed by being dissolved to $CrO_4^{2-}$ at a potential significantly lower that of the abovementioned electrolysis using a neutral salt. The concentration of a alkali metal hydroxide is preferably 30 to 50 wt% for electrolysis and 50 to 70 wt% for immersion. The temperature of the solution is in the range of 60° to 95° C. and the current density thereof if not less than 10 mA/dm$^2$ and preferably 1-10 mA/dm$^2$.

The electrolysis in an aqueous nitric acid solution dissolves iron in the scales. In this case, the electrolysis is effected by using the stainless steel as a cathode. Fe included in the spinel oxide scales contains divalent and trivalent iron. Although the divalent iron dissolves in a normal aqueous acid solution, the dissolution speed of the trivalent iron is very low. However, a practical dissolution speed can be obtained by reducing trivalent iron to divalent iron. The cathode electrolysis effected in an aqueous nitric acid solution supplies electrons to the stainless steel so as to reduce trivalent iron to divalent iron and, at the same time, removes iron as $Fe^{2+}$ ions by dissolving it in nitric acid, as shown by the following reaction formula:

$$Fe^{3+}\ (\text{oxide}) + e^- \rightarrow Fe^{2+}\ (ion)$$

The temperature of the solution is 40° to 80° C., and the current density thereof is not less than 10 mA/dm$^2$ and preferably 1 to 10 mA/dm$^2$. The concentration of nitric acid is preferably 5 to 20 wt%, and the concentrations of nitric acid and fluoric acid in the mixture thereof are preferably 10 to 20 wt% and 1 to 5 wt%, respectively.

The spinel oxide scales occurring on the stainless steel can be removed by the above-described three types of electrolysis with high levels of efficiency, workability and at a high speed.

In the combination of the three types of electrolysis, even if the order of the electrolysis in an aqueous neutral salt solution and the electrolysis in an aqueous nitric acid solution is changed, the same effect can be obtained. It is effective to perform the electrolysis in an aqueous nitric acid solution in the final step after the chromium oxide, which cannot be easily removed, has been removed.

Since the present invention is not accompanied by high-temperature treatment such as conventional treatment with a molten alkaline salt, the workability is significantly improved. The electrolysis in an aqueous neutral salt solution and the electrolysis in an aqueous nitric acid solution involves a problem with respect to its speed of dissolution of the scales caused by a slightly low degree of efficiency of the electrolysis in the aqueous neutral salt solution. However, this problem can be improved by alkali electrolysis having a high degree of efficiency, resulting in an increase in the speed of removal of scales.

In the method of descaling stainless steel of the present invention, when the amount of the scales is small, the anode electrolysis in an aqueous alkaline solution enables the chromium oxide to be dissolved simply by immersing the stainless steel in the aqueous solution, without electrolysis. Even if immersion in an aqueous solution of a mixture of nitric acid and fluoric acid is effected in place of the electrolysis in the aqueous nitric acid solution, the same descaling effect is obtained.

The present invention has the effect of rapidly descaling stainless steel without using a molten salt bath at a high temperature that cannot be easily handled. The present invention also has the effect of obtaining an attractive stainless steel plate of high quality having good surface conditions which cannot be obtained by conventional electrolysis.

BRIEF DESCRIPTION OF THE DRAWINGS

FIG. 1 shows an apparatus in Embodiment 1 of the method of descaling a stainless steel strip of the present invention. A stainless steel strip 1 which was cold-rolled by a 10-stage cold-rolling mill 15, annealed in a continuous annealing furnace 16 and then cooled by a cooling apparatus 17 and which had scales occurring on its surface is introduced into an electrolytic cell 2 containing an aqueous neutral salt solution through a looper 18. The electrolytic aqueous neutral salt solution cell 2 is filled with an aqueous solution of 20% $Na_2SO_4$ at pH 6. In the electrolytic cell 2, a positive voltage is applied to the stainless steel strip 1 from a pair of upper and lower positive electrodes 3, and a pair of counter electrodes 3' on both sides of the positive electrodes 3 serve as negative electrodes so that a current flows from the stainless steel strip 1 to the counter electrodes 3' through the aqueous $Na_2SO_4$ solution. The chromium in the scales is dissolved to $Cr_2O_7^{2-}$ ions by the flow of the current. The stainless steel strip 1 is then placed in a water washing bath 4 so that $Na_2SO_4$ remaining on the surface thereof is washed away with water. The strip 1 is then introduced into a wringer roll 5 squeezes out which the washing water and is then fed into an electrolytic cell 6 containing an aqueous alkaline solution. The electrolytic aqueous alkaline solution cell 6 is filled with an aqueous solution of 40% NaOH, and a positive voltage is applied to the stainless steel strip 1 from a pair of upper and lower positive electrodes 7 so that a current flows to a pair of upper and lower counter electrodes 7' through the aqueous NaOH solution. At this time, the current flowing causes the chromium oxide in the scales to be dissolved and removed as $CrO_4^{2-}$. The chromium oxide is removed from the surface of the stainless steel strip 1 and leaves ion oxides thereon. The stainless steel strip 1 is then introduced into a water-washing bath 8 in which the NaOH remaining on the surface is removed by a water wash, and is then fed into a wringer roll 9 which squeezes out the washing water. The stainless steel strip 1 is then introduced into an electrolytic aqueous nitric acid cell 10. The electrolytic aqueous nitric acid cell 10 is filled with an aqueous solution of 10% nitric acid, and current flows to the stainless steel strip 1 through a pair of upper and lower positive electrodes 11, which are provided on both the right and left sides of a pair of central counter electrodes 11' serving as negative electrodes. An insoluble electrode such as a titanium-palladium coated plate, a titanium-platinum coated plate or the like is used as each of the positive and negative electrodes 11 and 11' for the purpose of preventing the electrode from being consumed by dissolution in the aqueous nitric acid. These electrodes may be provided in a portion of the entire width of the steel strip 1 or over the entire width thereof. In this embodiment, the electrodes do not contact the steel strip, but if desired, the electrodes may be brought into contact with the steel strip. However, the former case is preferable. Since the stainless steel is subjected to cathode electrolysis, Fe(III) contained in the scales was reduced to Fe(II) to be dissolved to $Fe^{2+}$ in the aqueous solution, as described above. The scales composed of the iron-chromium spinel oxides which occur on the stainless steel strip ar removed by the above-described three types of electrolysis with a high level of efficiency and at a high speed. The stainless steel strip 1 is then introduced into a water-washing bath 12 in which the remaining $HNO_3$ is removed by water washing. As can be seen from Table 1, in the embodiment of the present invention, the scales are completely removed, and the surface of the stainless steel strip 1 exhibits a smooth, glossy and beautiful mirror surface after the scales have been removed.

Figure 1:
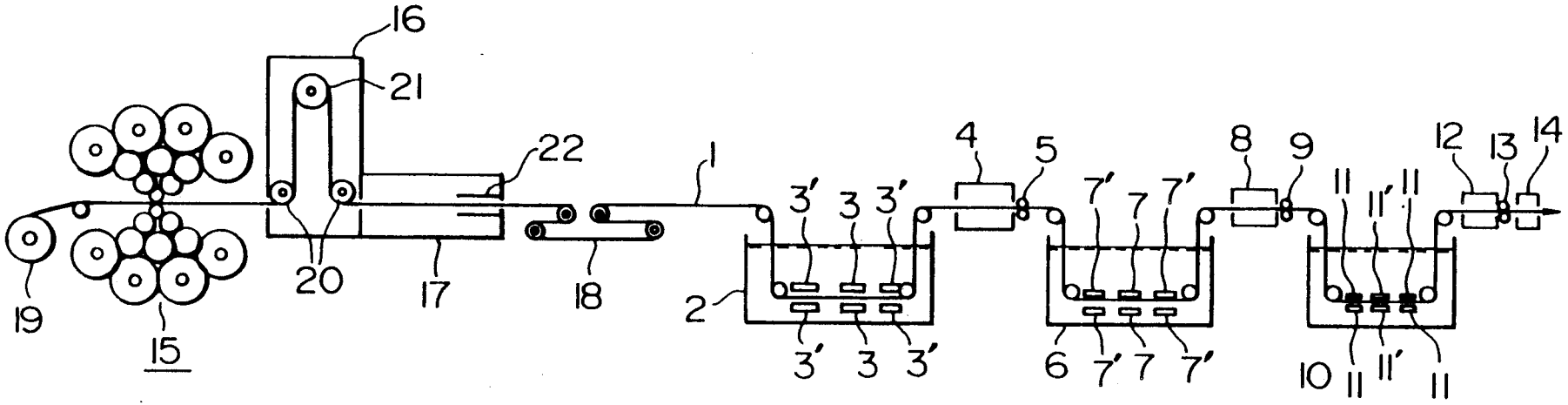
FIG. 1 is a drawing showing both apparatus and steps of the descaling process in an embodiment of the present invention.

On the contrary, in the comparative example shown in Table 1 which employed a conventional method, the scales were incompletely removed, or the stainless surface became cloudy and rough after the scales had been removed. In Embodiment 1, the stainless steel strip 1 discharged from the electrolytic aqueous nitric acid solution cell 10 is introduced into a water-washing bath 12 in which the $HNO_3$ remaining on the surface is removed, then into a wringer roll 13 which squeezes out the washing water, dried by a dryer 14 and then sent to the next step.

In the electrolysis of this embodiment, it is a matter of course that the scales can be easily removed by increasing the temperature of each of the electrolytic cells.

Table 1 shows the results of descaling stainless steel in Embodiment 1 and of descaling by conventional methods (aqueous neutral salt solution electrolysis+aqueous nitric acid solution electrolysis, aqueous neutral salt solution electrolysis+aqueous nitric acid-fluoric acid mixture immersion) in Comparative Examples 1 and 2. The stainless steel used was a ferritic AISI 430 0.5-mm thick plate. The conditions of the electrolysis were as follows:

Aqueous neutral salt solution electrolysis: anode electrolysis, current density of $6A/dm^2$ Aqueous alkaline solution electrolysis: anode electrolysis, current density of $3A/dm^2$ Aqueous nitric acid solution electrolysis: cathode electrolysis, current density of $2A/dm^2$ In this embodiment, as a result of the abovementioned electrolysis performed while the abovedescribed AISI430 steel strip was moved at a speed of 100 m/minute, the same results as those shown in Table 1 were obtained.

In addition, when AISI304 stainless steel was descaled by using immersion in a nitric acid-fluoric acid mixture in place of the aqueous nitric acid solution in the final step, it was confirmed that the scaling was able to be effectively performed.

It is also possible to alternately perform anode electrolysis and cathode electrolysis over a given length of the steel strip in the aqueous neutral salt solution electrolysis and the aqueous nitric acid solution electrolysis.

The descaled steel strip may be rinsed, bright-annealed and then coiled through a bridal roll, as occasion demands. The annealing furnace 16 may be such a system as heating the stainless steel strip through the Joule heat generated directly by direct electrical power in a non-oxidizing atmosphere such as $N_2$ gas or the like. Alternatively, the annealing may be effected by the heating of a combustion exhaust gas of liquified natural gas, butane gas and etc.

The above-mentioned descaling method enables a continuous production process comprising the steps of cold-rolling, annealing which descaling and thus enables treatment at the above-described speed of 100 m/minutes. Thus, this embodiment enables the treatment at a speed higher than 60 m/minute, the speed of conventional methods.

The direct heating by electric power is effected by applying high electrical current through a given length of the steel strip between turn rollers 20 and 21. The annealing is effected at a temperature of 850° to 1150° C. for about 3 minutes or less. After annealing, the steel strip is forced to be cooled to room temperature by the flowing of gas at high speed along the steel strip from a non-oxidizing gas flow apparatus 22.

At the anode electrolysis step, cathode electrolysis occurs at the portion of the central positive electrode 3 so that the reducing reaction of the scale was generated, while anode electrolysis occurs at both sides of the negative electrodes 3' shown in FIG. 1 so that an oxidation reaction is generated with the steel strip being dissolved to bring about the descaling thereof. Thus, the anode electrolysis step means that an area in which the anode electrolysis occurs is larger than another area in which the cathode electrolysis occurs.

The cathode electrolysis step is reverse to the anode electrolysis step with respect to the number of pieces of the positive and negative electrodes. That is, the area of the occurrence of cathode electrolysis is larger than the area of the occurrence of anode electrolysis at the cathode electrolysis step.

Each of the electrodes covers the whole width of the steel strip. Thus, a pair of front and rear electrodes may be one or a plurality of divided electrodes with respect to the whole width of the steel strip.

TABLE 1

| | Electrolysis time | | | | |
|---|---|---|---|---|---|
| | Neutral salt $Na_2SO_4$ 20%, 80° C. | Alkali NaOH 40%, 70° C. | Nitric acid 10%, 50° C. | Result of descaling | State of stainless steel surface |
| Embodiment 1 | 60 | 5 | 15 | ⊙ | Glossy, Smooth |
| Comparative example 1*1 | 60 | — | 25 | Δ | Cloudy, Smooth |
| Comparative example 2*2 | 60 | — (10% $HNO_3$ · 3% HF 40° C., 15 sec) | — | ⊙ | Cloudy, Very rough |

Figure 2:
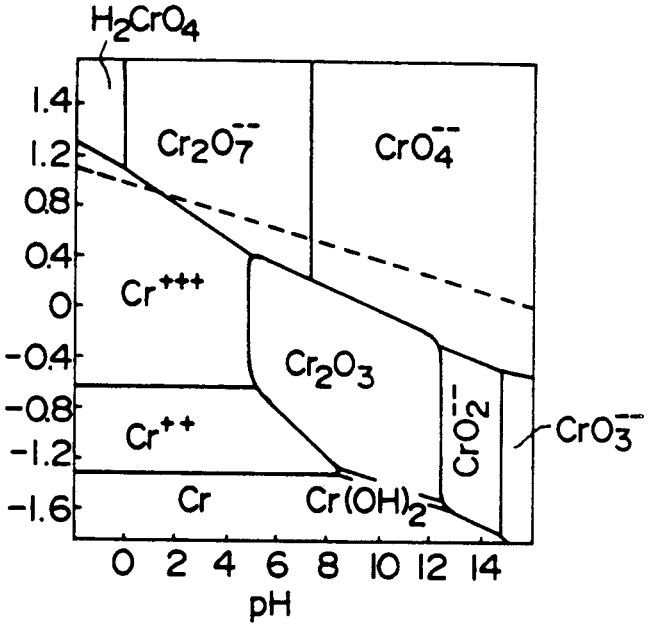
FIG. 2 is a potential-pH drawing of a Cr-$H_2O$ system for illustrating the function of the present invention.

*1 neutral salt electrolysis + nitric acid electrolysis
*2 neutral salt electrolysis + nitric acid-fluoric acid immersion FIG. 2 shows the potential-pH drawing (25° C.) of a Cr-$H_2O$ system. Embodiment 2 employs a method of descaling in which the order of the electrolytic aqueous neutral salt solution cell 2 and the electrolytic aqueous alkaline solution cell 6 in the process of the descaling method of Embodiment 1 is reversed. That is, a stainless steel strip is first placed in the electrolytic aqueous alkaline solution cell in which the strip is electrolyzed in the aqueous alkaline solution, while a positive voltage is applied to the strip. The stainless strip is then introduced into the electrolytic aqueous neutral salt cell where it is electrolyzed while a positive voltage is applied to the stainless steel strip. The stainless steel strip is then electrolyzed in the aqueous nitric acid solution cell, while a negative voltage is applied to the strip. Water washing effected between these stages of the electrolysis, water washing after the aqueous nitric acid solution electrolysis and the hydro-extraction are the same as those employed in Embodiment 1. This method enables an attainment of the stainless steel strip having a surface with smoothness, glossiness, and no scale. Table 2 shows the conditions and results of the treatment. Table 2 also shows the results of Embodiments 2 to 7.

TABLE 2

| | Treatment time | | | Result of descaling | State of stainless surface |
|---|---|---|---|---|---|
| Embodiment 2 | Alkali (E) 40% NaOH 70° C. 10 sec | Neutral salt (E) 20%, $Na_2SO_4$ 80° C., 50 sec | Nitric acid (E) 10% $HNO_3$ 50° C. 15 sec | ⊙ | Glossy, Smooth |
| Embodiment 3 | Neutral salt (E) 20% $Na_2SO_4$ 80° C. 60 sec | Alkali (I) 60% NaOH 90° C. 20 sec | Nitric acid (E) 10% $HNO_3$ 50° C. 15 sec | ○ | Glossy, Smooth |
| Embodiment 4 | Alkali (D) 60% NaOH 90° C. 20 sec | Neutral salt (E) 20% $Na_2SO_4$ 80° C. 60 sec | Nitric acid (E) 10% $HNO_3$ 50° C. 15 sec | ○ | Glossy, Smooth |
| Embodiment 5 | Neutral salt (E) 20% $Na_2SO_4$ 80° C. 60 sec | Alkali (E) 40% NaOH 70° C. 5 sec | Nitric acid-fluoric acid (I) 7% $HNO_3$, 2% HF, 60° C. 10 sec | ⊙ | Glossy, Smooth |
| Embodiment 6 | Alkali (E) 40% NaOH 70° C. 10 sec | Neutral salt (E) 20% $Na_2SO_4$ 80° C. 50 sec | Nitric acid-fluoric acid (I) 7% $HNO_3$ 2% HF 60° C. 10 sec | ⊙ | Slightly cloudy, Very rough |
| Embodiment 7 | Neutral salt (E) 20% $Na_2SO_4$ 80° C. 50 sec | Alkali (E) 60% NaOH 90° C. 30 sec | Nitric acid-fluoride acid (I) 7% $HNO_3$ 2% HF 60° C. 10 sec | ⊙ | Slightly cloudy, Very rough |

(E): Electrolysis, (I): Immersion
⊙: completely removed, ○: removed, Δ: slightly remaining
×: remaining in a great amount

What is claimed is:

1. A method of descaling stainless steel, comprising the steps of: anode-electrolyzing stainless steel in an aqueous neutral salt solution; anode-electrolyzing said stainless steel in an aqueous alkaline solution; and cathode-electrolyzing said stainless steel, which had been treated in said former two steps, in an aqueous nitric acid solution.

2. A method of descaling stainless steel, comprising the steps of: anode-electrolyzing stainless steel in an aqueous neutral salt solution; immersing said stainless steel in an aqueous alkaline solution; and cathode-electrolyzing said stainless steel, which had been treated in said former two steps, in an aqueous nitric acid solution.

3. A method of descaling stainless steel, comprising the steps of: anode-electrolyzing stainless steel in an aqueous neutral salt solution; anode-electrolyzing said stainless steel in an aqueous alkaline solution; and immersing said stainless steel, which had been treated in said former two steps, in an aqueous nitric acid-fluoric acid mixture.

4. A method of descaling stainless steel, comprising the steps of: anode-electrolyzing stainless steel in an aqueous neutral salt solution; immersing said stainless steel in an aqueous alkaline solution; and immersing said stainless steel, which had been treated in said former two steps, in an aqueous nitric acid-fluoric acid mixture.

5. A method of descaling a stainless steel strip which is cold-rolled and then annealed in a non-oxidizing atmosphere, comprising in turn the steps of: anode-electrolyzing said stainless steel strip in an aqueous neutral salt solution; anode-electrolyzing it in an aqueous alkaline solution; and cathode-electrolyzing said stainless steel strip in an aqueous nitric acid-fluoric acid mixture.

6. A method of continuously producing a stainless steel strip at a high speed, comprising in turn the steps of: cold-rolling a stainless steel material, which had been hot-rolled and then descaled, to thereby produce a cold-rolled strip; annealing said strip by electrical heating in a non-oxidizing atmosphere after said cold-rolling; cooling and then anode-electrolyzing said stainless steel strip in an aqueous neutral salt solution after said annealing; anode-electrolyzing in an aqueous alkaline solution and cathode-electrolyzing in an aqueous nitric acid solution.

7. A method of descaling a stainless steel strip, comprising in turn the steps of: anode-electrolyzing an austenite stainless steel strip in an aqueous neutral salt solution; immersing said strip in an aqueous alkaline solution, and cathode-electrolyzing said strip in an aqueous nitric acid solution.

8. A method of descaling stainless steel, comprising the steps of: electrolyzing stainless steel in an aqueous neutral salt solution; electrolyzing said stainless steel in an aqueous alkaline solution; and electrolyzing said stainless steel, which had been treated in said former two steps, in an aqueous nitric acid solution.

9. An apparatus for continuously descaling stainless steel, comprising an electrolytic aqueous neutral salt solution cell having a plurality of positive and negative electrodes, an electrolytic aqueous alkaline solution cell having a plurality of positive and negative electrodes, and an electrolytic aqueous nitric acid solution cell which is provided behind said former two cells and which has a plurality of positive and negative electrodes.

10. An apparatus for continuously descaling stainless steel, comprising an electrolytic aqueous neutral salt solution cell having a plurality of positive and negative electrodes, an aqueous alkaline solution cell for immersion, and an electrolytic aqueous nitric acid solution cell which is provided behind said former two cells and which has a plurality of positive and negative electrodes.

11. An apparatus for continuously descaling stainless steel, comprising an electrolytic aqueous natural salt solution cell having a plurality of positive and negative electrodes, an electrolytic aqueous alkaline solution cell having a plurality of positive and negative electrodes, and an aqueous nitric acid-fluoric acid mixture cell for immersion which is provided behind said former two cells.

12. An apparatus for continuously descaling stainless steel, comprising an electrolytic aqueous neutral salt solution cell having a plurality of positive and negative electrodes, an aqueous alkaline solution cell for immersion, and an aqueous nitric acid-fluoric acid mixture cell for immersion which is provided behind said former two cells.

13. An apparatus for continuously producing a stainless steel strip; comprising a cold-rolling mill for cold-rolling a stainless steel material, which had been hot-rolled and descaled, to thereby provide a cold-rolled strip; an annealing furnace for annealing said strip by electrically heating in a non-oxidizing atmosphere after said colt-rolling; cooling means for cooling after said annealing; and descaling means for descaling after said cooling, said descaling means comprising an electrolytic aqueous neutral salt solution cell having a plurality of positive and negative electrodes, an electrolytic aqueous alkaline solution cell having a plurality of positive and negative electrodes, an electrolytic aqueous nitric acid solution cell which is provided behind said former two electrolytic cells and which has a plurality of positive and negative electrodes.

14. A method of descaling stainless steel, comprising the steps of:

removing a chromium oxide layer formed on the surface of stainless steel by anode-electrolyzing said stainless steel in an aqueous solution of $Na_2SO_4$;

removing a chromium oxide layer containing manganese and iron by anode-electrolyzing said stainless steel in an aqueous alkaline solution, or by immersing said stainless steel in an aqueous alkaline solution, after said chromium oxide layer has been removed; and removing ion oxide by electrolyzing said stainless steel in an aqueous nitric acid solution, or by immersing said stainless steel in an aqueous nitric acid fluoric acid mixture.

15. A method of descaling stainless steel, comprising the steps of:

anode-electrolyzing said stainless steel in an aqueous solution $Na_2SO_4$;

anode-electrolyzing said stainless steel in an aqueous alkaline solution, or immersing said stainless steel in said aqueous alkaline solution, after said chromium oxide layer has been removed; and electrolyzing said stainless steel in an aqueous nitric acid solution or immersing said stainless steel in an aqueous nitric acid fluoric acid mixture.

16. Stainless steel obtained by removing oxide scales occurring on its surface, which removing is effected by electrolysis in an aqueous neutral salt solution and by electrolysis or immersion in an aqueous alkaline solution and then by electrolysis in an aqueous nitric acid solution or immersion in an aqueous nitric acid-fluoric acid mixture, and having substantially no scale and a surface with excellent glossiness and smoothness.

* * * * *